US011465419B2

(12) United States Patent
Fukasawa et al.

(10) Patent No.: US 11,465,419 B2
(45) Date of Patent: Oct. 11, 2022

(54) LIQUID CONTAINER

(71) Applicant: SEIKO EPSON CORPORATION, Tokyo (JP)

(72) Inventors: Noriyuki Fukasawa, Matsumoto (JP); Hiroyuki Kawate, Hokuto (JP); Taku Ishizawa, Matsumoto (JP); Takumi Nagashima, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 7 days.

(21) Appl. No.: 17/221,496

(22) Filed: Apr. 2, 2021

(65) Prior Publication Data

US 2021/0309015 A1 Oct. 7, 2021

(30) Foreign Application Priority Data

Apr. 3, 2020 (JP) ..... JP2020-067240

(51) Int. Cl.
*B41J 2/175* (2006.01)

(52) U.S. Cl.
CPC .. *B41J 2/17513* (2013.01); *B41J 2002/17516* (2013.01)

(58) Field of Classification Search
CPC ..... B41J 2/17513; B41J 2002/17516; B41J 2/17523; B41J 2/17553; B41J 2/17503
USPC ..... 347/86
See application file for complete search history.

(56) References Cited

U.S. PATENT DOCUMENTS 5,666,146 A 9/1997 Mochizuki et al.
2004/0032470 A1* 2/2004 Perkins ..... B29C 66/242 347/86
2006/0038863 A1* 2/2006 Piccinino, Jr. ..... B41J 2/17509 347/86

FOREIGN PATENT DOCUMENTS

JP H05-16377 A 1/1993

* cited by examiner

*Primary Examiner* — Kristal Feggins
*Assistant Examiner* — Alexander D Shenderov
(74) *Attorney, Agent, or Firm* — Oliff PLC

(57) ABSTRACT

A liquid container includes: a bag that contains a liquid; and a pair of members configured to be reused when the liquid container is reassembled by replacing the bag used. The pair of members are fixed to each other by one or more swaging pins.

8 Claims, 13 Drawing Sheets

LIQUID CONTAINER

The present application is based on, and claims priority from JP Application Serial Number 2020-067240, filed Apr. 3, 2020, the disclosure of which is hereby incorporated by reference herein in its entirety.

BACKGROUND

1. Technical Field

The present disclosure relates to liquid containers.

2. Related Art

Some ink cartridges include: a replaceable ink bag; a case that accommodates the ink bag; and a lid that covers one surface of the case. JP-A-5-16377 discloses an example of such ink cartridges which includes: a lid that has pairs of projections and claws; and a case that has pairs of holes and notches. When the lid is attached to the case, the projections of the lid are inserted into the respective holes of the case, and the claws of the lid mate with the respective recesses of the case in a snap-fit manner. In addition, the case also has a rear surface with a notch, which is covered with a caution label bonded on both the rear and upper surfaces of the case. To detach the lid from the case, a user has only to insert a tool into the case through the notch and then twist this tool.

As opposed to ink cartridges in which a lid is ultrasonically welded to a case, the above ink cartridge can be continuously used without the case and the lid discarded even after the ink bag has become empty. When the ink is fully consumed, a user can replace the empty ink bag with a new one by detaching the lid from the case in the above manner. Furthermore, the caution label that is bonded on the ridge between the case and the lid helps prevent the lid from being accidentally detached from the case, for example, when the ink cartridge is vibrated or shocked. Also, the caution label that hides the notch is effective in reducing the risk of a user detaching the lid deliberately.

The disclosed ink cartridge, unfortunately, may have some disadvantages. The caution label that has been bonded to the case of the ink cartridge may adhere to the case with time and due to temperature changes, and thus a user has trouble peeling off the caution label when replacing the ink bag. In this case, if the user peels off this caution label by using a certain tool, he/she may accidentally damage the case or the lid of the ink cartridge or may break the claws that have lost their sufficient flexibility by undergoing temperature changes. In which case, the case or lid can be no longer used.

SUMMARY

The present disclosure is a liquid container that includes: a bag that contains a liquid; and a pair of members configured to be reused when the liquid container is reassembled by replacing the bag used. The pair of members are fixed to each other by one or more swaging pins.

DESCRIPTION OF EXEMPLARY EMBODIMENTS

A. First Embodiment

Figure 1:
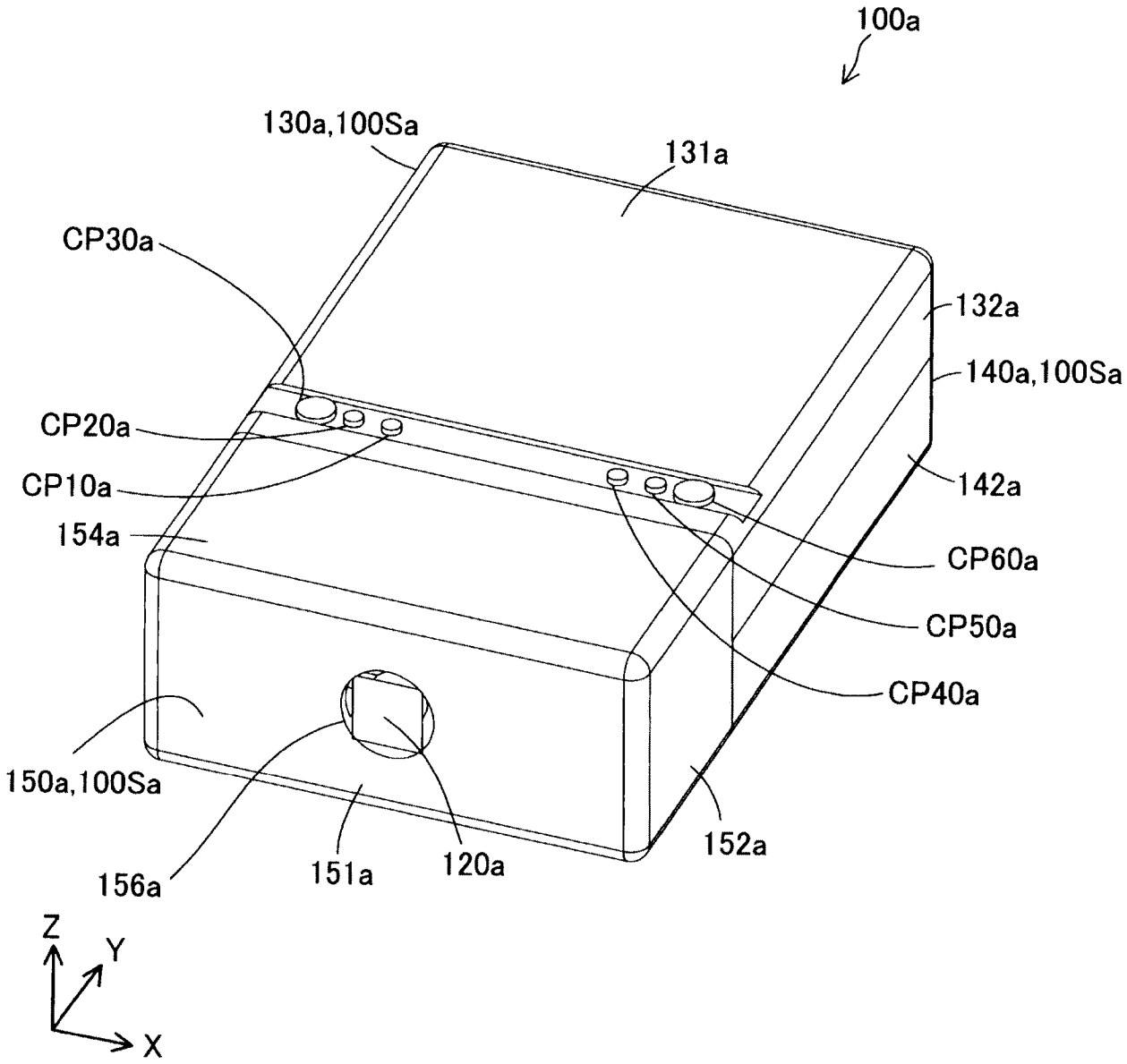
FIG. 1 is a perspective view of a liquid container in a first embodiment of the present disclosure.
Figure 2:
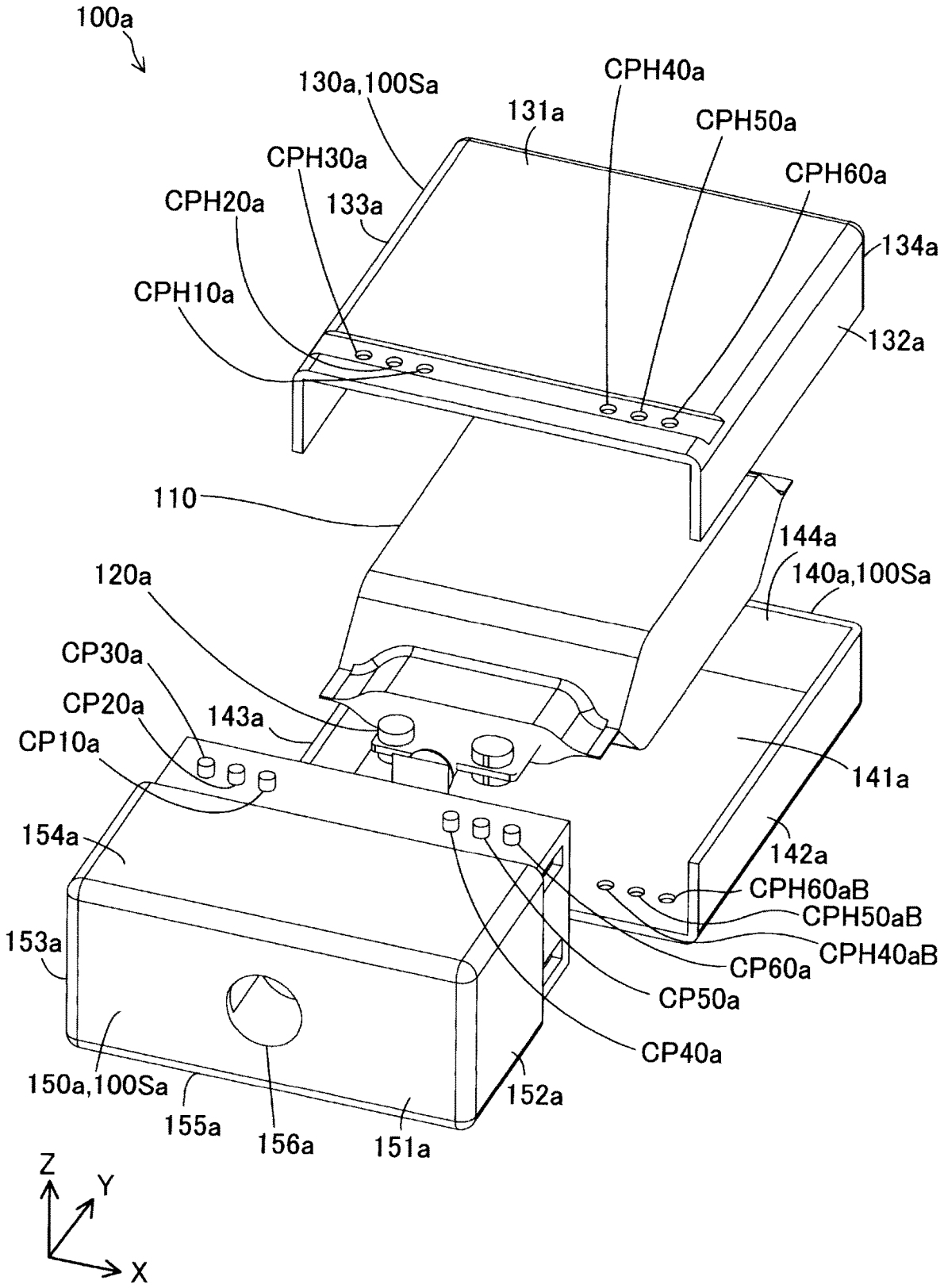
FIG. 2 is an exploded perspective view of the liquid container.

FIG. 1 is a perspective view of a liquid container 100*a* in a first embodiment of the present disclosure; FIG. 2 is an exploded perspective view of the liquid container 100*a*. When the liquid container 100*a* is mounted in a liquid consuming apparatus, a liquid contained in the liquid container 100*a* is supplied to the liquid consuming apparatus.

In FIG. 1, X-, Y-, and Z-axial arrows are described perpendicularly to one another. The Y-axial arrow is parallel to the long sides of the liquid container 100*a*. The liquid container 100*a* is inserted into the liquid consuming apparatus in the direction of the Y-axial arrow. The X-axial arrow is parallel to the short sides, or the width, of the liquid container 100*a*. The Z-axial arrow is parallel to the height of the liquid container 100*a*. It should be noted that those X-, Y-, and Z-axial arrows are consistently related to those in the other drawings. Hereinafter, the direction of the X-axial arrow is defined as the +X direction whereas the opposite direction is defined as the −X direction; the direction of the Y-axial arrow is defined as the +Y direction whereas the opposite direction is defined as the −Y direction; and the direction of the Z-axial arrow is defined as the +Z direction whereas the opposite direction is defined as the −Z direction.

The liquid container 100*a* includes a bag 110, a fixing member 120*a*, a first case 130*a*, a second case 140*a*, and a lid 150*a*, all of which constitute an outer shell 100Sa, as illustrated in FIG. 1. The outer shell 100Sa is a substantially rectangular parallelepiped case that surrounds and accommodates the bag 110. The liquid container 100*a* can be reassembled without the outer shell 100Sa discarded when both the bag 110 that has been empty and the fixing member 120*a* are replaced.

The bag 110, which may be made of a flexible sheet material, contains a liquid to be supplied to the outside, as illustrated in FIG. 2. The bag 110 shrinks mainly in the Z direction in proportion to the amount of liquid supplied to the outside, namely, in inverse proportion to the amount of liquid left therein.

The fixing member 120*a* is a member equipped with the bag 110, which fixes the bag 110 to the outer shell 100Sa, as illustrated in FIG. 2. The fixing member 120*a* has a liquid passage that leads to the interior of the bag 110. Through this liquid passage, the liquid is to be supplied from the bag 110 to the outside of the liquid container 100*a*. As illustrated in FIGS. 1 and 2, the liquid passage is formed in the Y direction, and the opening of the liquid passage in the fixing member 120*a* is sealed with a rectangular film.

The first case 130*a* includes a first wall 131*a*, a second wall 132*a*, a third wall 133*a*, and a fourth wall 134*a*, as illustrated in FIG. 2, each of which may have a substantially rectangular, flat shape. Herein, the word "wall" refers to a flat part that may have some steps, grooves, uneven or inclined areas, holes, or slits.

The first wall 131*a* is a substantially rectangular, flat part disposed in parallel to the XY plane in FIGS. 1 and 2. The second wall 132*a* is a flat part that extends vertically from one short side of the first wall 131*a*. The third wall 133*a* is a flat part that extends vertically from the other short side of the first wall 131*a* and faces the second wall 132*a*. The fourth wall 134*a* is a flat part that extends vertically from one long side of the first wall 131*a*. One short side of the fourth wall 134*a* is coupled to a short side of the second wall 132*a*, whereas the other short side of the fourth wall 134*a* is coupled to a short side of the third wall 133*a*.

The first wall 131*a*, the second wall 132*a*, the third wall 133*a*, and the fourth wall 134*a* of the first case 130*a* define a substantially rectangular parallelepiped space in which a portion of the bag 110 is accommodated, as illustrated in FIG. 2.

The first wall 131*a* has six through-holes: through-holes CPH10*a* to CPH60*a*, as illustrated in FIG. 2. The through-holes CPH10*a* to CPH60*a* are arrayed near and along one of the short sides of the first wall 131*a* which is not coupled to the fourth wall 134*a*. In other words, the through-holes CPH10*a* to CPH60*a* are arrayed in the +X direction in FIG. 2.

The second case 140*a* includes a first wall 141*a*, a second wall 142*a*, a third wall 143*a*, and a fourth wall 144*a*, as illustrated in FIG. 2. The first wall 141*a* has six through-holes: through-holes CPH10*a*B to CPH60*a*B. It should be noted that the third wall 143*a* and the through-holes CPH10*a*B to CPH30*a*B are hidden in FIGS. 1 and 2.

When the liquid container 100*a* is completely assembled, the second case 140*a* is substantially symmetrical to the first case 130*a* with respect to the plane parallel to the XY plane. The first wall 141*a*, the second wall 142*a*, the third wall 143*a*, and the fourth wall 144*a* of the second case 140*a* define a substantially rectangular parallelepiped space in which another portion of the bag 110 is accommodated, as illustrated in FIG. 2.

The lid 150*a* includes a first wall 151*a*, a second wall 152*a*, a third wall 153*a*, a fourth wall 154*a*, and a fifth wall 155*a*, as illustrated in FIG. 2, each of which may have a substantially rectangular, flat shape.

The first wall 151*a* is a substantially rectangular, flat part disposed in parallel to the XZ plane in FIGS. 1 and 2. The second wall 152*a* is a flat part that extends vertically from one short side of the first wall 151*a*. The third wall 153*a* is a flat part that extends vertically from the other short side of the first wall 151*a* and faces the second wall 152*a*.

The fourth wall 154*a* is a flat part that extends vertically from one long side of the first wall 151*a*. The fifth wall 155*a* is a flat part that extends vertically from the other long side of the first wall 151*a* and faces the fourth wall 154*a*.

One short side of the fourth wall 154*a* is coupled to a side of the second wall 152*a*, whereas the other short side of the fourth wall 154*a* is coupled to a side of the third wall 153*a*. One short side of the fifth wall 155*a* is coupled to another side of the second wall 152*a*, whereas the other short side of the fifth wall 155*a* is coupled to another side of the third wall 153*a*.

The first wall 151*a*, the second wall 152*a*, the third wall 153*a*, the fourth wall 154*a*, and the fifth wall 155*a* of the lid 150*a* define a substantially rectangular parallelepiped space in which still another portion of the bag 110 and the fixing member 120*a* are accommodated, as illustrated in FIG. 2.

The first wall 151*a* has a through-hole 156*a* that formed vertically across the first wall 151*a* substantially at the center. The first wall 151*a* is fixed to the fixing member 120*a* while positioning a portion of the fixing member 120*a* inside the through-hole 156*a*, so that the bag 110 is fixed to an outer shell 100Sa. Through the through-hole 156*a*, the liquid passage of the fixing member 120*a* leads to the outside, as illustrated in FIG. 1. The end of the liquid passage of the fixing member 120*a* is sealed with the rectangular film, as illustrated in FIG. 1.

The fourth wall 154*a* has six projections: projections CP10*a* to CP60*a*. The projections CP10*a* to CP60*a* are arrayed near and along one of the long sides of the fourth wall 154*a* which is not coupled to the first wall 151*a*. In other words, the projections CP10*a* to CP60*a* are arrayed in the +X direction in FIG. 2. All of the projections CP10*a* to CP60*a* protrude vertically from the fourth wall 154*a* in the +Z direction in FIG. 2.

Each of the projections CP10*a* to CP60*a* may act as a swaging pin. Herein, the "swaging pin" refers to a member that fixes a pair of members to each other with its end deformed. Functions of the projections CP10*a* to CP60*a* will be described later.

The fifth wall 155*a* has sixth projections: projections CP10*a*B to CP60*a*B. When the liquid container 100*a* is completely assembled, the fifth wall 155*a* is substantially symmetrical to the fourth wall 154*a* with respect to the plane parallel to the XY plane. It should be noted that the fifth wall 155*a* and the projections CP10*a*B to CP60*a*B are hidden in FIGS. 1 and 2.

To assemble the liquid container 100*a*, the fixing member 120*a* equipped with the bag 110, the first case 130*a*, the second case 140*a*, and the lid 150*a* are first prepared, as illustrated in FIG. 2. Then, the fixing member 120*a* is attached to the lid 150*a*, after which the first case 130*a* is joined to the second case 140*a* with both the lid 150*a* and the bag 110 therebetween.

Figure 3:
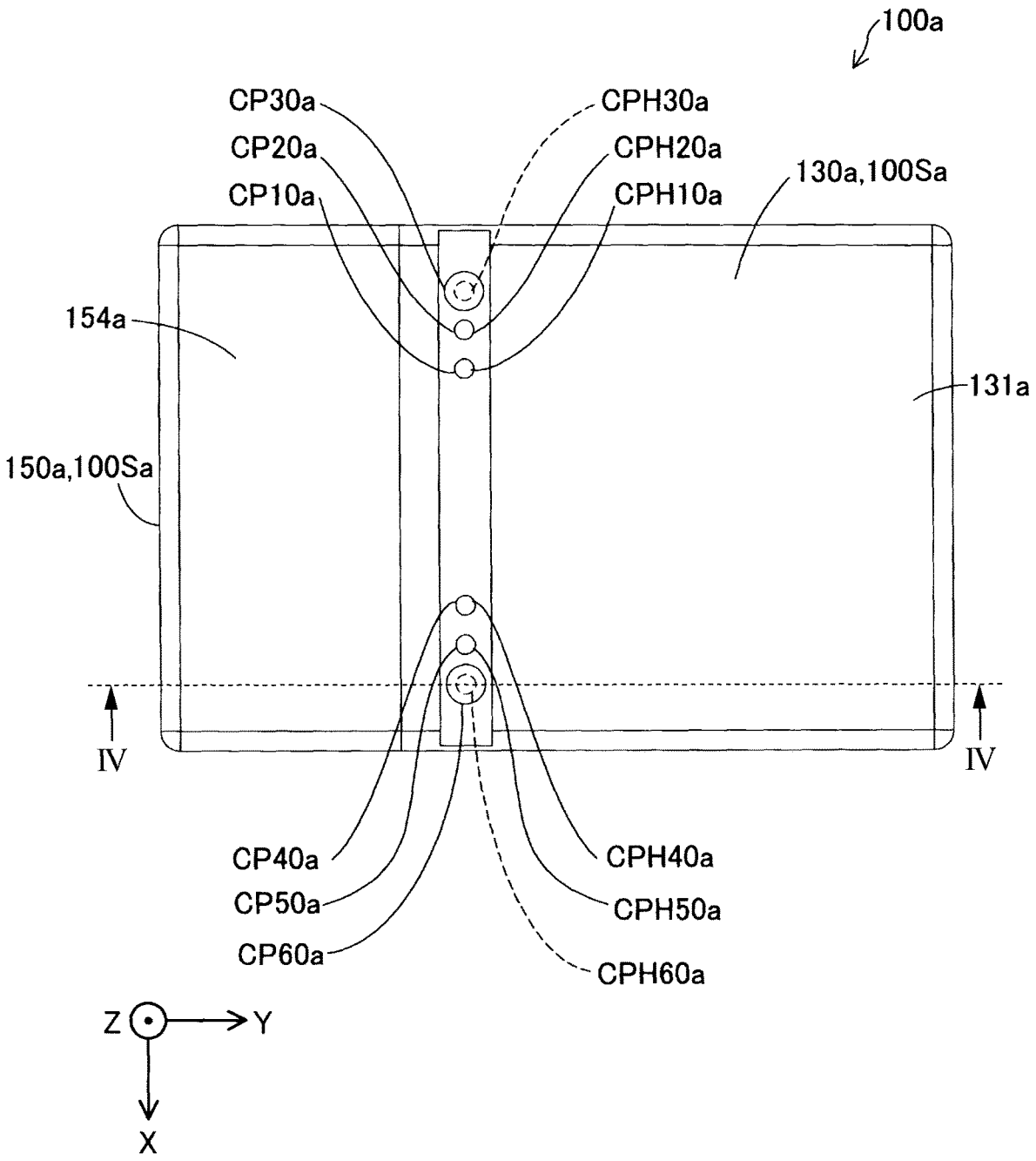
FIG. 3 is a top view of the liquid container.
Figure 4:
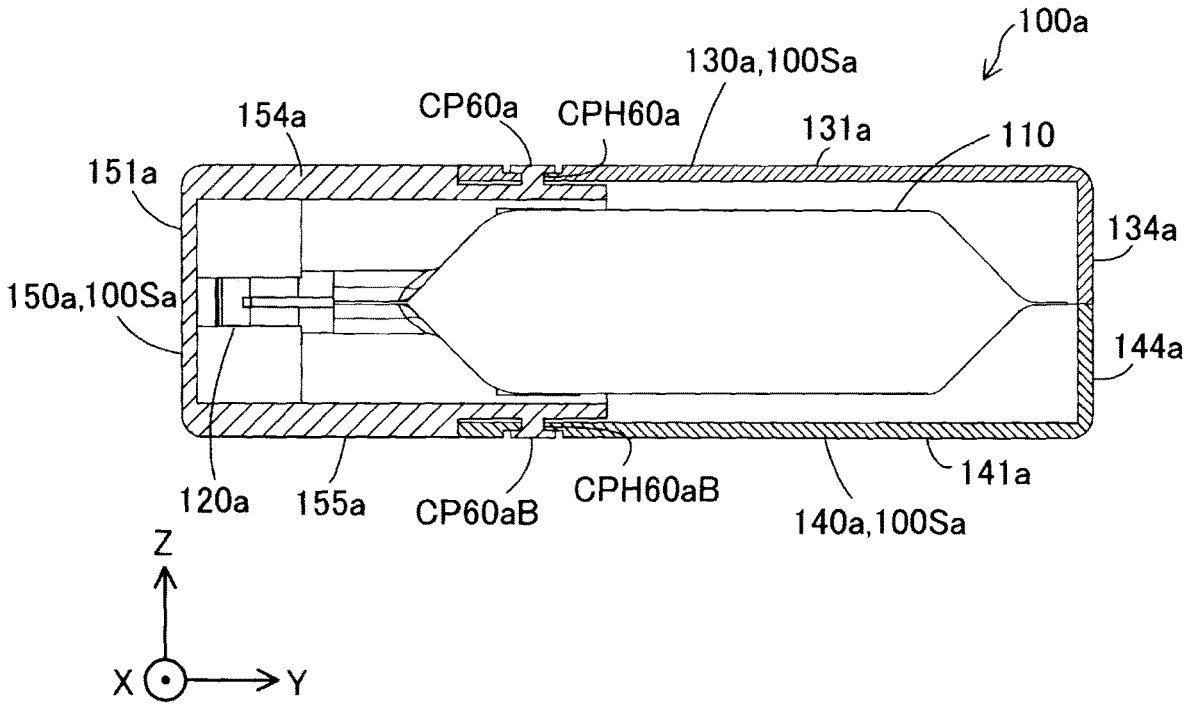
FIG. 4 is a cross-sectional view of the liquid container taken along the line IV-IV in FIG. 3.

FIG. 3 is a top view of the liquid container 100*a*; FIG. 4 is a cross-sectional view of the liquid container 100*a* taken along the line IV-IV in FIG. 3. When joining the first case 130*a* to the second case 140*a*, a user inserts the projections CP10*a* to CP60*a* of the lid 150*a*, respectively, into the through-holes CPH10*a* to CPH60*a* of the first case 130*a*, as illustrated in FIGS. 2 to 4. When using the lid 150*a*, the first case 130*a*, and the second case 140*a* for the first time to assemble the liquid container 100*a*, he/she deforms the ends of the projections CP30*a* and CP60*a*, which are ones of the projections CP10*a* to CP60*a* positioned near the respective edges of the fourth wall 154*a*, as illustrated in FIGS. 1, 3, and 4. More specifically, he/she widens the ends of the projections CP30*a* and CP60*a* to the extent that the end of the projection CP30*a* cannot be inserted into the through-hole CPH30*a* and the end of the projection CP60*a* cannot be inserted into the through-hole CPH60*a*. In this way, the first case 130*a* is fixed to the lid 150*a* by the projections CP30*a* and CP60*a*, each of which may act as the swaging pin.

Likewise, the user inserts the projections CP10*a*B to CP60*a*B of the lid 150*a*, respectively, into the through-holes CPH10*a*B to CPH60*a*B of the second case 140*a*. When using the lid 150*a*, the first case 130*a*, and the second case 140*a* for the first time to assemble the liquid container 100*a*, he/she deforms the ends of the projections CP30*a*B and CP60*a*B, which are ones of the projections CP10*a*B to CP60*a*B positioned near the respective edges of the fifth wall 155*a*. More specifically, he/she widens the ends of the projections CP30*a*B and CP60*a*B to the extent that the end of the projection CP30*a*B cannot be inserted into the through-hole CPH30*a*B and the end of the projection CP60*a*B cannot be inserted into the through-hole CPH60*a*B. In this way, the second case 140*a* is fixed to the lid 150*a* by the projections CP30*a*B and CP60*a*B, each of which may act as the swaging pin.

In the liquid container 100*a*, the lid 150*a* is provided with the projections CP10*a* to CP60*a* configured to fix the lid 150*a* to the first case 130*a*. Furthermore, the lid 150*a* is also provided with the projections CP10*a*B to CP60*a*B configured to fix the lid 150*a* to the second case 140*a*. When the liquid container 100*a* is completely assembled, the lid 150*a* is fixed to the first case 130*a* by the projections CP30*a* and CP60*a*, which are ones of the projections CP10*a* to CP60*a*, and the lid 150*a* is also fixed to the second case 140*a* by the projections CP30*a*B and CP60*a*B, which are ones of the projections CP10*a*B to CP60*a*B.

When the liquid in the bag 110 is fully consumed, a user needs to perform the following steps, including a step of replacing the empty bag 110 and the fixing member 120*a* with new ones, in order to reassemble the liquid container 100*a*. First, he/she breaks the ends of the projections CP30*a*, CP60*a*, CP30*a*B, and CP60*a*B, each of which may act as the swaging pin, and separates the first case 130*a*, the second case 140*a*, and the lid 150*a* from one another. Then, he/she detaches an old bag 110 and fixing member 120*a* from the lid 150*a* and in turn attaches a new bag 110 and fixing member 120*a* to the lid 150*a*. After that, he/she joins the first case 130*a* to the second case 140*a* with the lid 150*a*, the fixing member 120*a* and the bag 110 therebetween.

After the above steps, the user deforms and widens the ends of projections CP20*a* and CP50*a*, which are ones of the projections CP10*a* to CP60*a*, to the extent that the end of the projection CP20*a* cannot be inserted into the through-hole CPH20*a* and the end of the projection CP50*a* cannot be inserted into the through-hole CPH50*a*, like the projections CP30*a* and CP60*a* illustrated in FIGS. 1, 3, and 4. In this way, when the liquid container 100*a* is used for the second time, the lid 150*a* is fixed to the first case 130*a* by the projections CP20*a* and CP50*a*, each of which may act as the swaging pin.

Likewise, the user deforms and widens the ends of the projections CP20*a*B and CP50*a*B, which are ones of the projections CP10*a*B to CP60*a*B, to the extent that the end of the projection CP20*a*B cannot be inserted into the through-hole CPH20*a*B and the end of the projection CP50*a*B is inserted into the through-hole CPH50*a*B. In this way, when the liquid container 100*a* is used for the second time, the lid 150*a* is fixed to the second case 140*a* by the projections CP20*a*B and CP50*a*B, each of which may act as the swaging pin.

When the liquid in the replaced bag 110 is fully consumed again, the user has only to perform the above steps, including a step of replacing the empty bag 110 and the fixing member 120*a* with new ones, in order to assemble the liquid container 100*a*. At this time, however, he/she deforms and widens the ends of projections CP10*a* and CP40*a*, which are ones of the projections CP10*a* to CP60*a*, to the extent that the end of the projection CP10*a* cannot be inserted into the through-hole CPH10*a* and the end of the projection CP40*a* cannot be inserted into the through-hole CPH40*a*, like the projections CP30*a* and CP60*a* illustrated in FIGS. 1, 3, and 4. In this way, when the liquid container 100*a* is used for the third time, the lid 150*a* is fixed to the first case 130*a* by the projections CP10*a* and CP40*a*, each of which may act as the swaging pin.

Likewise, the user deforms and widens the ends of the projections CP10*a*B and CP40*a*B, which are ones of the projections CP10*a*B to CP60*a*B, to the extent that the projection CP10*a*B cannot be inserted into the through-hole CPH10*a*B and the end of the projection CP40*a*B cannot be inserted into the through-hole CPH40*a*B. In this way, when the liquid container 100*a* is used for the third time, the lid 150*a* is fixed to the second case 140*a* by the projections CP10*a*B and CP40*a*B, each of which may act as the swaging pin.

As described above, when replacing the fixing member 120*a* and the bag 110 in order to assemble the liquid container 100*a*, the user can separate the first case 130*a*, the second case 140*a*, and the lid 150*a* from one another simply by breaking some of the projections CP30*a* to CP60*a* and CP30*a*B to CP60*a*B, each of which may act as the swaging pin. Therefore, the configuration in the first embodiment enables the user to easily reassemble the liquid container 100*a* even if the liquid container 100*a* has undergone temperature changes.

After replacing the fixing member 120*a* and the bag 110, the user can fix the lid 150*a*, the first case 130*a*, and the second case 140*a* to one another simply by using unused ones of the projections CP10*a* to CP60*a* and CP10*a*B to CP60*a*B. Therefore, the configuration in the first embodiment, when the liquid container 100*a* is reassembled, can maintain the strength at which the first case 130*a*, the second case 140*a*, and the lid 150*a* are fixed to one another, regardless of how many times the first case 130*a*, the second case 140*a*, and the lid 150*a* have been reused.

In the first embodiment, the number of times that the first case 130*a*, the second case 140*a*, and the lid 150*a* can be reused is related to the number of projections of the lid 150*a*. Therefore, the user can easily know how many times the lid 150*a*, the first case 130*a*, and the second case 140*a* can be reused, based on the configuration of the liquid container 100*a*.

Herein, the combination of the lid 150*a* and the first case 130*a* or the combination of the lid 150*a* and the second case 140*a* in the first embodiment may correspond to a pair of members, and each of projections CP30*a* to CP60*a* and CP30*a*B to CP60*a*B in the first embodiment may correspond to a swaging pin.

B. Second Embodiment

Figure 5:
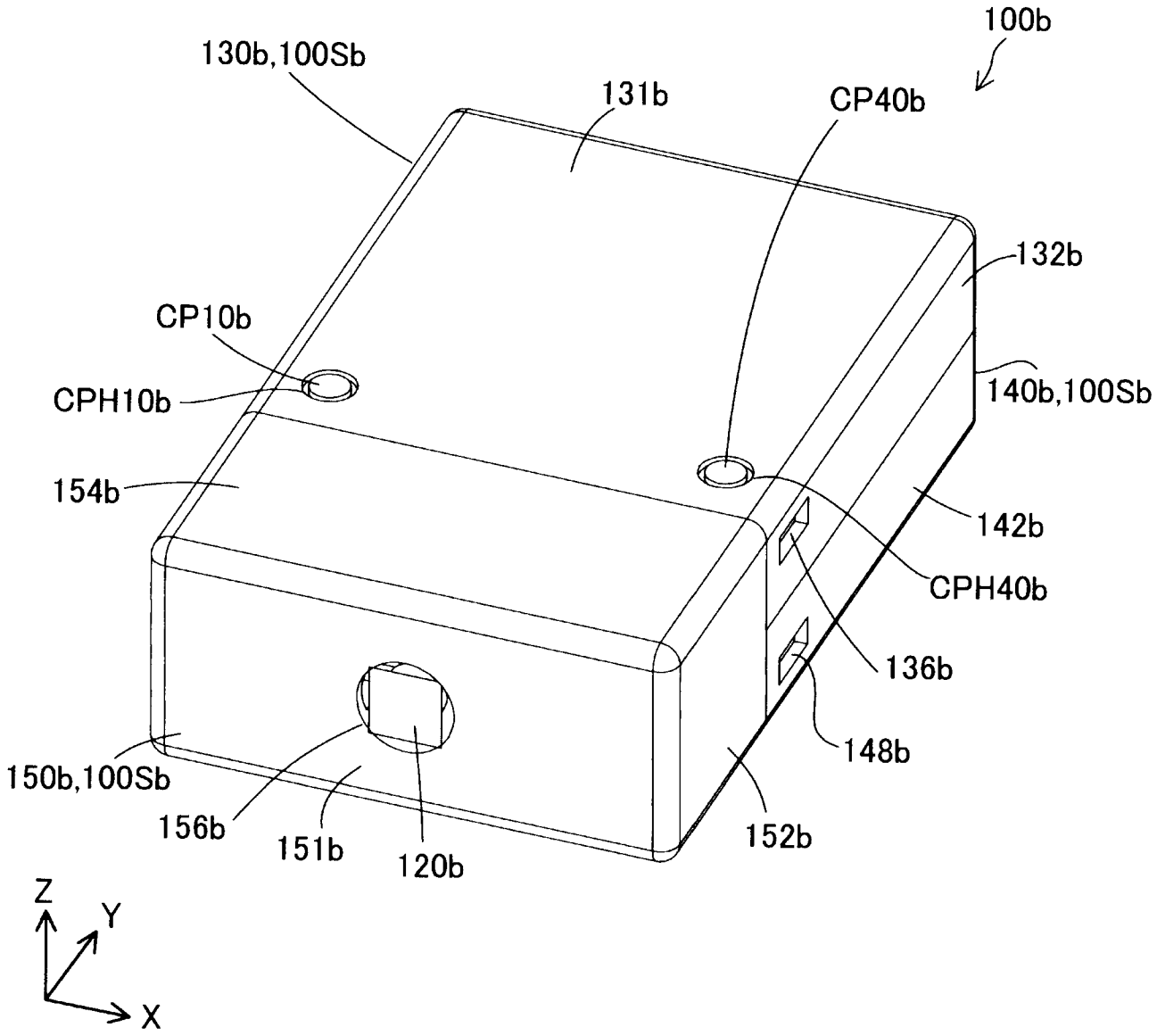
FIG. 5 is a perspective view of a liquid container in a second embodiment of the present disclosure.
Figure 6:
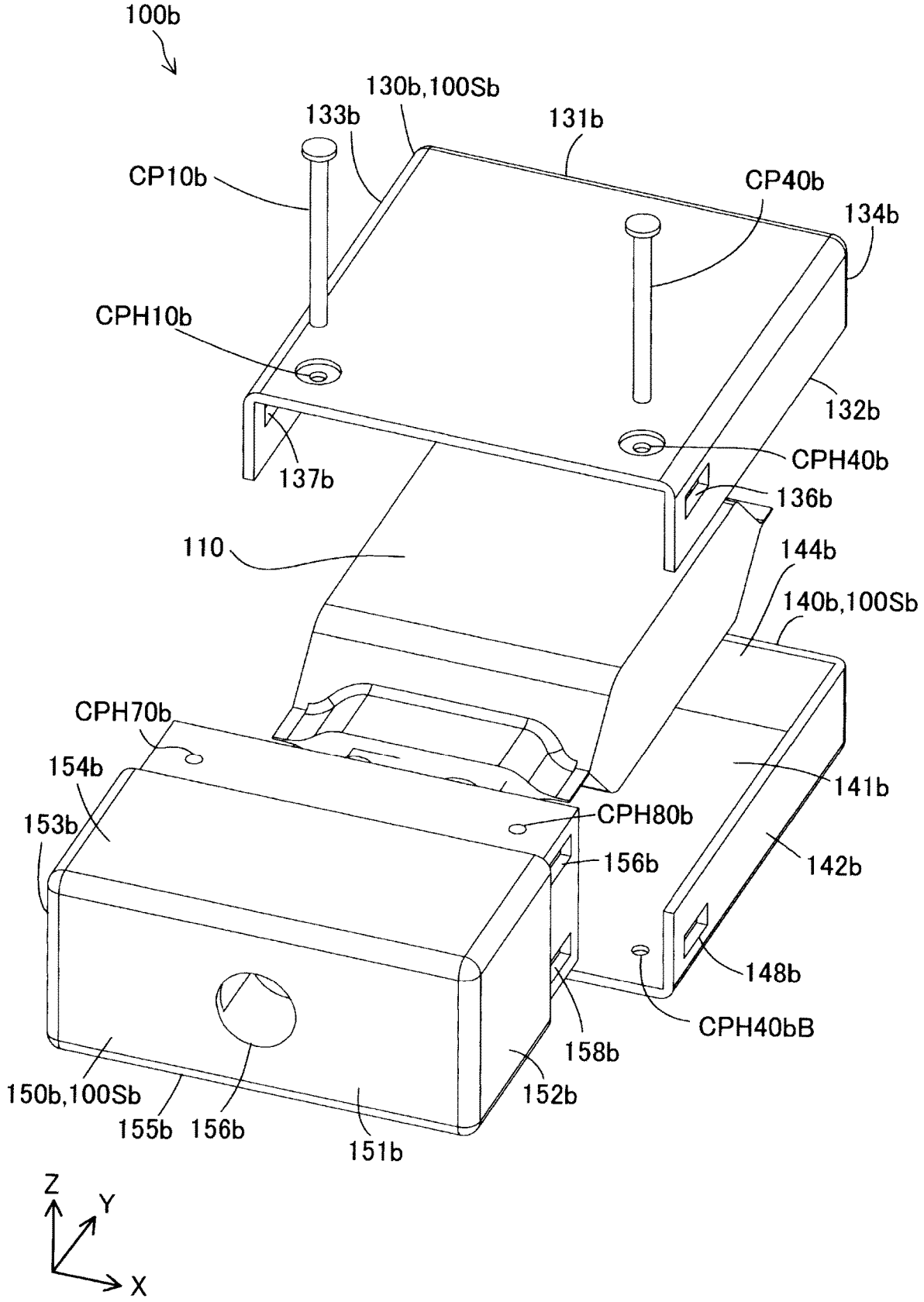
FIG. 6 is an exploded perspective view of the liquid container.

FIG. 5 is a perspective view of a liquid container 100*b* in a second embodiment of the present disclosure; FIG. 6 is an exploded perspective view of the liquid container 100*b*. Most of the configuration in the liquid container 100*b* is substantially the same as that in the liquid container 100*a* in the foregoing first embodiment. Thus, only different configuration features of the liquid container 100*b* will be described below. Therefore, configuration features of the liquid container 100*b* which will not be described below are substantially the same as those of the liquid container 100*a*.

In individual drawings, components of the liquid container 100*b* which correspond to those in the liquid container 100*a* are denoted by reference characters ending in "b" instead of "a".

In the liquid container 100*b*, a first wall 131*b* of a first case 130*b* includes two through-holes: through-holes CPH10*b* and CPH40*b*, instead of the through-holes CPH10*a* to CPH60*a*. The through-holes CPH10*b* and CPH40*b* are arrayed near and along one of the long sides of the first wall 131*b* which is not coupled to a fourth wall 134*b*. In other words, the through-holes CPH10*b* and CPH40*b* are arrayed in the +X direction in FIG. 6. Both of the through-holes CPH10*b* and CPH40*b* are formed vertically across the first wall 131*b*. Formed around the aperture of the through-hole CPH10*b* on the outer surface of an outer shell 100Sb is a countersink, which receives the flange of a swaging pin CP10*b*. Likewise, formed around the aperture of the through-hole CPH40*b* on the outer surface of the outer shell 100Sb is a countersink, which receives the flange of a swaging pin CP40*b*.

A second wall 132*b* of the first case 130*b* has a through-hole 136*b*, as illustrated in FIGS. 5 and 6, which is positioned near one of the long sides of the second wall 132*b* which is coupled to the first wall 131*b* and one of the short sides of the second wall 132*b* which is not coupled to the fourth wall 134*b*. The through-hole 136*b* is formed vertically across the second wall 132*b*. The through-hole 136*b* has a substantially rectangular shape with the long sides parallel to those of the second wall 132*b*. The through-hole 136*b* is formed so as to be elongated in the +Y axis in FIG. 6.

A third wall 133*b* of the first case 130*b* has a through-hole 137*b*, as illustrated in FIG. 6, which is positioned near one of the long sides of the third wall 133*b* which is coupled to the first wall 131*b* and one of the short sides of the third wall 133*b* which is not coupled to the fourth wall 134*b*. The through-hole 137*b* is formed vertically across the third wall 133*b*. The through-hole 137*b* has a substantially rectangular shape with the long sides parallel to those of the third wall 133*b*. The through-hole 137*b* is formed so as to be elongated in the +Y axis in FIG. 6.

When the liquid container 100*b* is completely assembled, a second case 140*b* is substantially symmetrical to the first case 130*b* with respect to the plane parallel to the XY plane, as illustrated in FIGS. 5 and 6.

A first wall 141*b* of the second case 140*b* has through-holes CPH10*b*B and CPH40*b*B. When the liquid container 100*b* is completely assembled, the through-hole CPH10*b*B is substantially symmetrical to the through-hole CPH10*b* of the first case 130*b* with respect to the plane parallel to the XY plane, whereas the through-hole CPH40*b*B is substantially symmetrical to the through-hole CPH40*b* of the first case 130*b* with respect to the plane parallel to the XY plane.

A second wall 142*b* of the second case 140*b* has a through-hole 148*b*. When the liquid container 100*b* is completely assembled, the through-hole 148*b* is substantially symmetrical to the through-hole 136*b* of the first case 130*b* with respect to the plane parallel to the XY plane, as illustrated in FIGS. 5 and 6. A third wall 143*b* of a second case 140*b* has a through-hole 149*b*. When the liquid container 100*b* is completely assembled, the through-hole 149*b* is substantially symmetrical to the through-hole 137*b* of the first case 130*b* with respect to the plane parallel to the XY plane. It should be noted that the third wall 143*b* and the through-hole 149*b* of the second case 140*b* are hidden in FIGS. 5 and 6.

A fourth wall 154*b* of the lid 150*b* of the liquid container 100*b* has two through-holes: through-holes CPH70*b* and CPH80*b*, as illustrated in FIG. 6, instead of the above projections CP10*a* to CP60*a*. The through-holes CPH70*b* and CPH80*b* are arrayed near and along one of the long sides of the fourth wall 154*b* which is not coupled to a first wall 151*b*. In other words, the through-holes CPH70*b* and CPH80*b* are arrayed in the +X direction in FIG. 6. Both of the through-holes CPH70*b* and CPH80*b* are formed vertically across the fourth wall 154*b*.

A fifth wall 155*b* of the lid 150*b* is substantially symmetrical to the fourth wall 154*b* with respect to the plane parallel to the XY plane. The fifth wall 155*b* of the lid 150*b* has two through-holes: through-holes CPH70*b*B and CPH80*b*B, instead of the above projections CP10*a*B to CP60*a*B. The through-hole CPH70*b*B is substantially symmetrical to the through-hole CPH70*b* of the fourth wall 154*b* with respect to the plane parallel to the XY plane, whereas the through-hole CPH80*b*B is substantially symmetrical to the through-hole CPH80*b* of the fourth wall 154*b* with respect to the plane parallel to the XY plane. It should be noted that the fifth wall 155*b* and the through-holes CPH70*b*B and CPH80*b*B are hidden in FIGS. 5 and 6.

A second wall 152*b* of the lid 150*b* has through-holes 156*b* and 158*b*, as illustrated in FIG. 6. The through-holes 156*b* and 158*b* are arrayed near and along one of the short sides of the second wall 152*b* which is not coupled to the first wall 151*b*. In other words, the through-holes 156*b* and 158*b* are arrayed in the +Z direction in FIG. 6. Both of the through-holes 156*b* and 158*b* are formed vertically across the second wall 152*b*. Each of the through-holes 156*b* and 158*b* has a substantially rectangular shape with the long sides parallel to those of the second wall 152*b*. Each of the through-holes 156*b* and 158*b* is formed so as to be elongated in the +Y axis in FIG. 6.

A third wall 153*b* of the lid 150*b* is substantially symmetrical to the second wall 152*b* with respect to the plane parallel to the YZ plane. The third wall 153*b* of the lid 150*b* has through-holes 157*b* and 159*b*. The through-hole 157*b* is substantially symmetrical to the through-hole 156*b* of the second wall 152*b* with respect to the plane parallel to the YZ plane, whereas the through-hole 159*b* is substantially symmetrical to the through-hole 158*b* of the fourth wall 154*b* with respect to the plane parallel to the YZ plane. It should be noted that the third wall 153*b* and the through-holes 157*b* and 159*b* are hidden in FIGS. 5 and 6.

When the lid 150*b*, the first case 130*b*, and the second case 140*b* that have been joined together are viewed from the −Z direction, the through-hole CPH10*b* of the first case 130*b* is overlaid with the through-hole CPH70*b* of the lid 150*b*, and the through-hole CPH70*b*B of the lid 150*b* is overlaid with the through-hole CPH10*b*B of the second case 140*b*, as illustrated in FIG. 6.

Likewise, when the lid 150*b*, the first case 130*b*, and the second case 140*b* that have been joined together are viewed from the −Z direction, the through-hole CPH40*b* of the first case 130*b* is overlaid with the through-hole CPH80*b* of the lid 150*b*, and the through-hole CPH80*b*B of the lid 150*b* is overlaid with the through-hole CPH40*b*B of the second case 140*b*, as illustrated in FIG. 6.

When the lid 150*b*, the first case 130*b*, and the second case 140*b* that have been joined together are viewed from the −X direction, the through-hole 136*b* of the first case 130*b* is overlaid with the through-hole 156*b* of the lid 150*b*, and the through-hole 148*b* of the second case 140*b* is overlaid with the through-hole 158*b* of the lid 150*b*, as illustrated in FIG. 6.

Likewise, when the lid 150*b*, the first case 130*b*, and the second case 140*b* that have been joined together are viewed from the +X direction, the through-hole 137*b* of the first case 130*b* is overlaid with the through-hole 157*b* of the lid 150*b*, and the through-hole 149*b* of the second case 140*b* is overlaid with the through-hole 159*b* of the lid 150*b*.

The liquid container 100*b* is provided with the swaging pins CP10*b* and CP40*b*, each of which is a bar-shaped member that has a flange at its end and that is independent of both the first case 130*b* and the second case 140*b*, unlike the projections CP10*a* to CP60*a* and CP10*a*B to CP60*a*B in the foregoing first embodiment.

Figure 7:
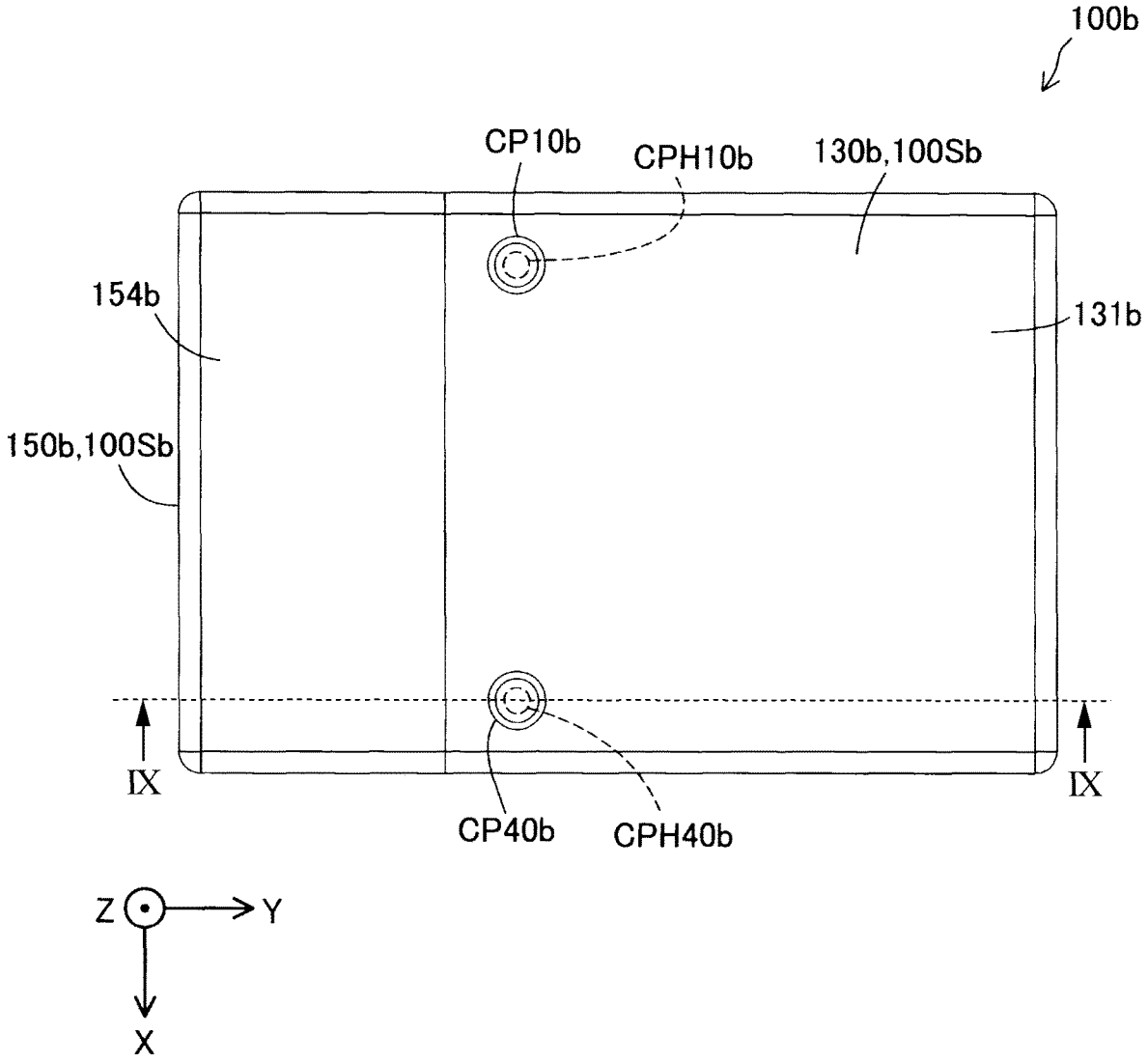
FIG. 7 is a top view of the liquid container.
Figure 8:
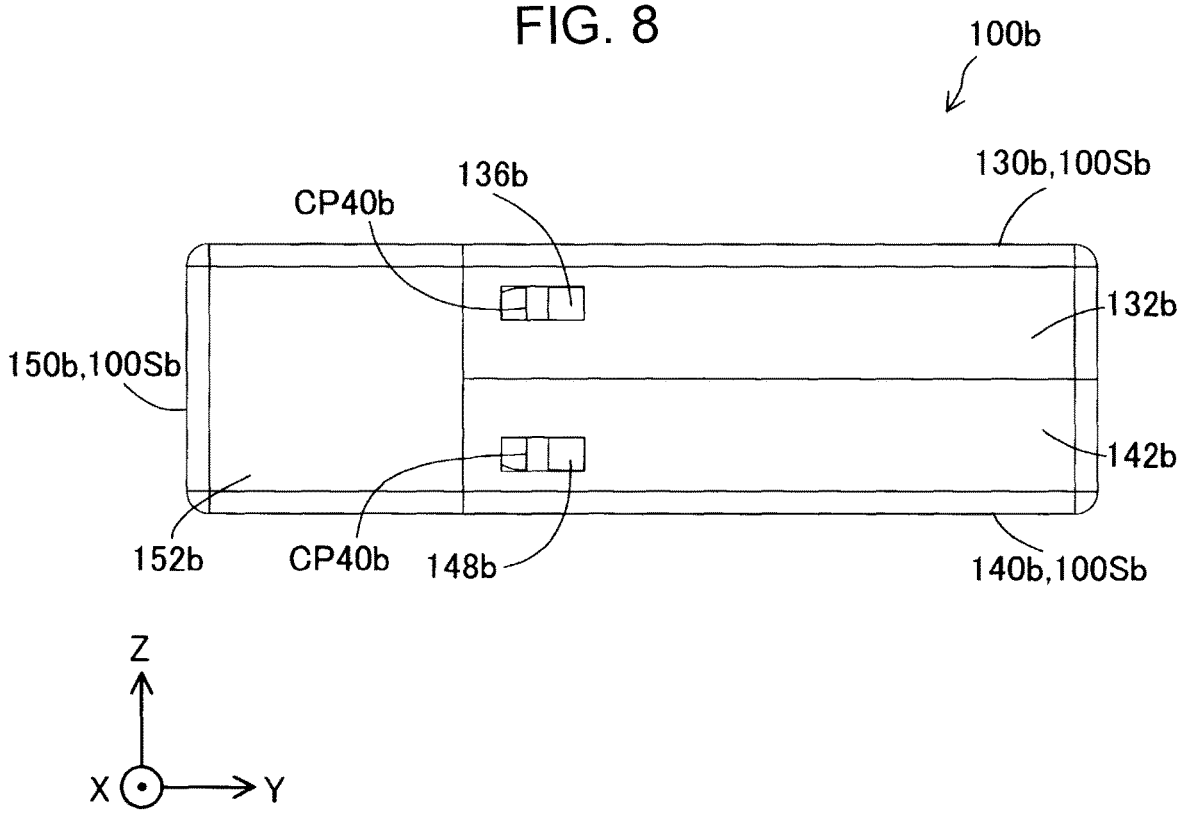
FIG. 8 is a side view of the liquid container.

FIG. 7 is a top view of the liquid container 100*b*; FIG. 8 is a side view of the liquid container 100*b*; and FIG. 9 is a cross-sectional view of the liquid container 100*b* taken along the line IX-IX in FIG. 7.

When joining the first case 130*b*, the second case 140*b*, and the lid 150*b* together, a user passes the swaging pin CP10*b* through the through-hole CPH10*b* of the first case 130*b*, the through-holes CPH70*b* and CPH70*b*B of the lid 150*b*, and the through-hole CPH10*b*B of the second case 140*b* while aligning the through-holes CPH10*b*, CPH70*b*, CPH70*b*B, and CPH10*b*B with one another, as illustrated in FIGS. 6 and 7. Likewise, the user passes the swaging pin CP40*b* through the through-hole CPH40*b* of the first case 130*b*, the through-holes CPH80*b* and CPH80*b*B of the lid 150*b*, and the through-hole CPH40*b*B of the second case 140*b* while aligning the through-holes CPH40*b*, CPH80*b*, CPH80*b*B, and CPH40*b*B with one another, as illustrated in FIGS. 6, 7, and 9. In this case, the swaging pins CP10*b* and CP40*b* do not interfere with the mounting of a bag 110 and a fixing member 120*b* inside an outer shell 100Sb.

After having passed the swaging pins CP10*b* and CP40*b*, the user deforms the end of the swaging pin CP10*b* which protrudes from the second case 140*b* via the through-hole CPH10*b*B. More specifically, he/she widens the end of the swaging pin CP10*b* to the extent that the end of the swaging pin CP10*b* cannot be inserted into the through-hole CPH10*b*B of the second case 140*b*, thereby forming a flange of the swaging pin CP10*b*. Likewise, he/she deforms the end of the swaging pin CP40*b* which protrudes from the second case 140*b* via the through-hole CPH40*b*B. More specifically, he/she widens the end of the swaging pin CP40*b* to the extent that the end of the swaging pin CP40*b* cannot be inserted into the through-hole CPH40*b*B of the second case 140*b*, thereby forming a flange of the swaging pin CP40*b*, as illustrated in FIG. 9. In this way, the first case 130*b*, the second case 140*b*, and the lid 150*b* are fixed to one another by the swaging pins CP10*b* and CP40*b*.

Figure 9:
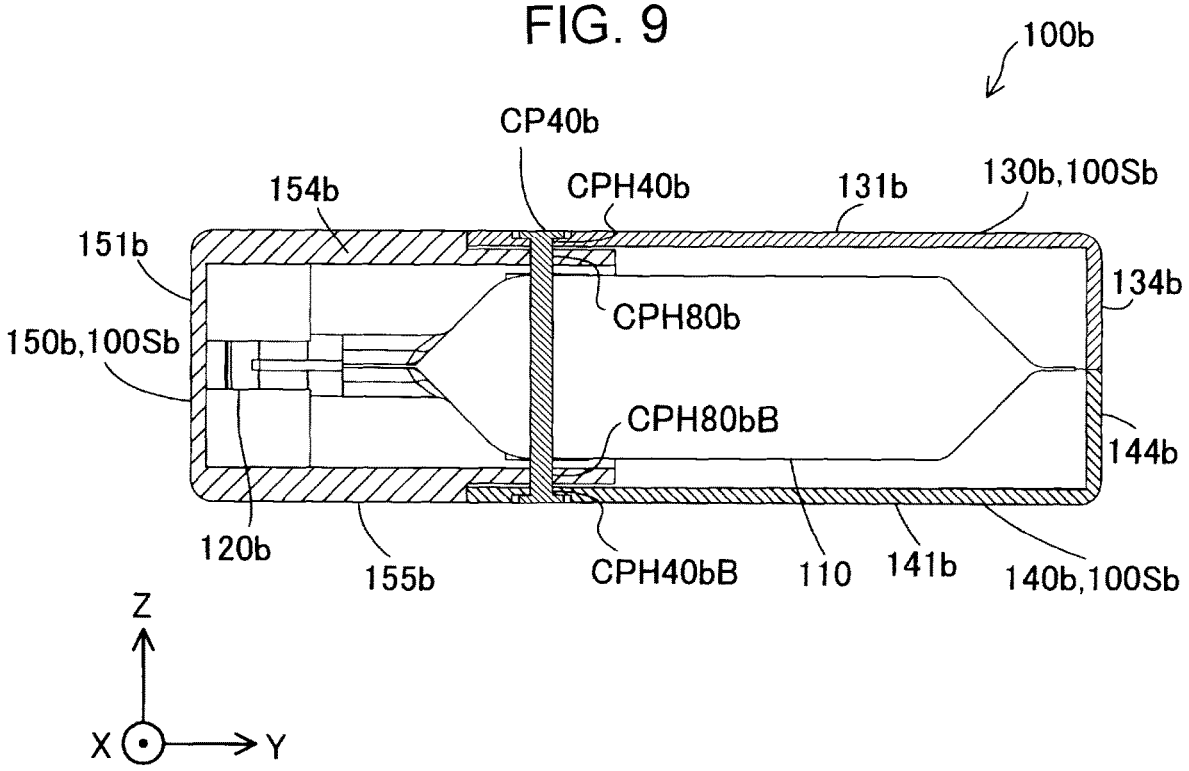
FIG. 9 is a cross-sectional view of the liquid container taken along the line IX-IX in FIG. 7.

When the liquid container 100*b* is completely assembled, the first case 130*b*, the second case 140*b*, and the lid 150*b* are fixed to one another by the swaging pins CP10*b* and CP40*b*, as illustrated in FIGS. 5, 7, and 9.

When the liquid container 100*b* is completely assembled, the swaging pin CP40*b* is viewable from the outside via the through-hole 136*b* of the first case 130*b* and the through-hole 156*b* of the lid 150*b*, as illustrated in FIGS. 6 and 8. In addition, the swaging pin CP40*b* is also viewable from the outside via the through-hole 148*b* of the second case 140*b* and the through-hole 158*b* of the lid 150*b*, as illustrated in FIGS. 6 and 8.

Likewise, the swaging pin CP10*b* is viewable from the outside via the through-hole 137*b* of the first case 130*b* and the through-hole 157*b* of the lid 150*b*. In addition, the swaging pin CP10*b* is also viewable from the outside via the through-hole 149*b* of the second case 140*b* and the through-hole 159*b* of the lid 150*b*.

When the liquid in the bag 110 is fully consumed, the user needs to perform the following steps, including a step of replacing the fixing member 120*b* and the bag 110 with new ones, in order to reassemble the liquid container 100*b*.

The user inserts a cutting tool into the outer shell 100Sb via the through-hole 137*b* of the first case 130*b* and the through-hole 157*b* of the lid 150*b* or via the through-hole 149*b* of the second case 140*b* and the through-hole 159*b* of the lid 150*b* and then cuts off the swaging pin CP10*b*. Likewise, he/she inserts the cutting tool into the outer shell 100Sb via the through-hole 136*b* of the first case 130*b* and the through-hole 156*b* of the lid 150*b* or via the through-hole 148*b* of the second case 140*b* and the through-hole 158*b* of the lid 150*b* and then the cut off the swaging pin CP40*b*, as illustrated in FIGS. 6 and 8. Then, he/she removes the swaging pins CP10*b* and CP40*b* from the outer shell 100Sb and then separates the first case 130*b*, the second case 140*b*, and the lid 150*b* from one another.

The configuration in the second embodiment enables the user to easily break the swaging pins CP10*b* and CP40*b* from the outside of the outer shell 100Sb via through-holes formed in the outer shell 100Sb and then remove the swaging pins CP10*b* and CP40*b* therefrom.

After having separated the first case 130*b*, the second case 140*b*, and the lid 150*b* from one another, the user attaches a new fixing member 120*b* and bag 110 to the lid 150*b*. Then, he/she joins the lid 150*b*, the first case 130*b*, and the second case 140*b* together with the fixing member 120*b* and the bag 110 therebetween.

After having joined the lid 150*b*, the first case 130*b*, and the second case 140*b* together, the user passes a new swaging pin CP10*b* through the through-hole CPH10*b* of the first case 130*b*, the through-hole CPH70*b* and CPH70*b*B of the lid 150*b*, and the through-hole CPH10*b*B of the second case 140*b* while aligning the through-holes CPH10*b*, CPH70*b*, CPH70*b*B, and CPH10*b*B with one another, as illustrated in FIGS. 6 and 7. Likewise, he/she passes a new swaging pin CP40*b* through the through-hole CPH40*b* of the first case 130*b*, the through-hole CPH80*b* and CPH80*b*B of the lid 150*b*, and the through-hole CPH40*b*B of the second case 140*b* while aligning the through-holes CPH40*b*, CPH80*b*, CPH80*b*B, and CPH40*b*B with one another, as illustrated in FIGS. 6, 7, and 9. Then, he/she widens the end of the swaging pin CP10*b* to the extent that the end of the swaging pin CP10*b* cannot be inserted into the through-hole CPH10*b*B of the second case 140*b*, thereby forming the flange of the swaging pin CP10*b*. Likewise, he/she widens the end of the swaging pin CP40*b* to the extent that the end of the swaging pin CP40*b* cannot be inserted into the through-hole CPH40*b*B of the second case 140*b*, thereby forming the flange of the swaging pin CP40*b*, as illustrated in FIG. 9. In this way, the first case 130*b*, the second case 140*b*, and the lid 150*b* are fixed to one another by the swaging pins CP10*b* and CP40*b*.

To reassemble the liquid container 100*b*, the user can fix the lid 150*b*, the first case 130*b*, and the second case 140*b* to one another simply by using new swaging pins CP10*b* and CP40*b*. Therefore, the configuration in the second embodiment, when the liquid container 100*b* is reassembled, can maintain the strength at which the first case 130*b*, the second case 140*b*, and the lid 150*b* are fixed to one another, regardless of how many times the first case 130*b*, the second case 140*b*, and the lid 150*b* have been reused.

In the second embodiment, the user can reuse the first case 130*b*, the second case 140*b*, and the lid 150*b* regardless of how many times the swaging pins CP10*b* and CP40*b* have been broken in order to assemble the liquid container 100*b*.

In the second embodiment, the liquid container 100*b* permits the swaging pins CP10*b* and CP40*b* to be deformed or damaged when the lid 150*b*, the first case 130*b*, and the second case 140*b* are detached from one another. This is because the swaging pins CP10*b* and CP40*b* can be replaced with new ones when the liquid container 100*b* is reassembled. However, it is preferable for the lid 150*b*, the first case 130*b*, and the second case 140*b* not to be deformed or damaged when the lid 150*b*, the first case 130*b*, and the second case 140*b* are detached from one another. This is because all of the lid 150*b*, the first case 130*b*, and the second case 140*b* need to be reused when the liquid container 100*b* is reassembled. In the second embodiment, as described above, the combination of the swaging pins CP10*b* and CP40*b* and the combination of the lid 150*b*, the first case 130*b*, and the second case 140*b* have different roles and functions. This configuration makes it possible to easily design parts of the lid 150*b*, the first case 130*b*, and the second case 140*b* which receive the swaging pins CP10*b* and CP40*b*.

Herein, the combination of the lid 150*b* and the first case 130*b* or the combination of the lid 150*b* and the second case 140*b* in the second embodiment may correspond to a pair of members.

C. Third Embodiment

Figure 10:
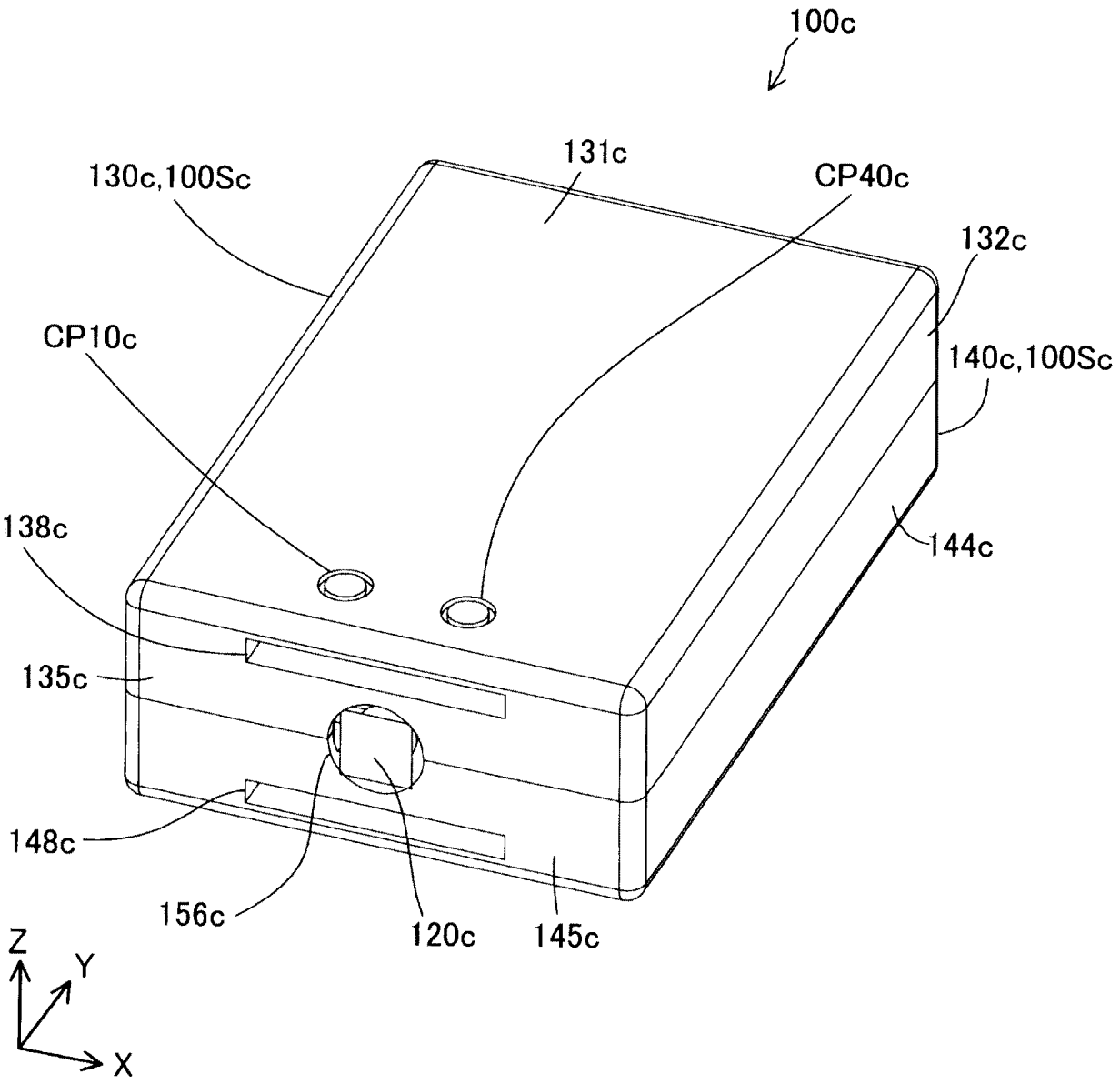
FIG. 10 is a perspective view of a liquid container in a third embodiment of the present disclosure.
Figure 11:
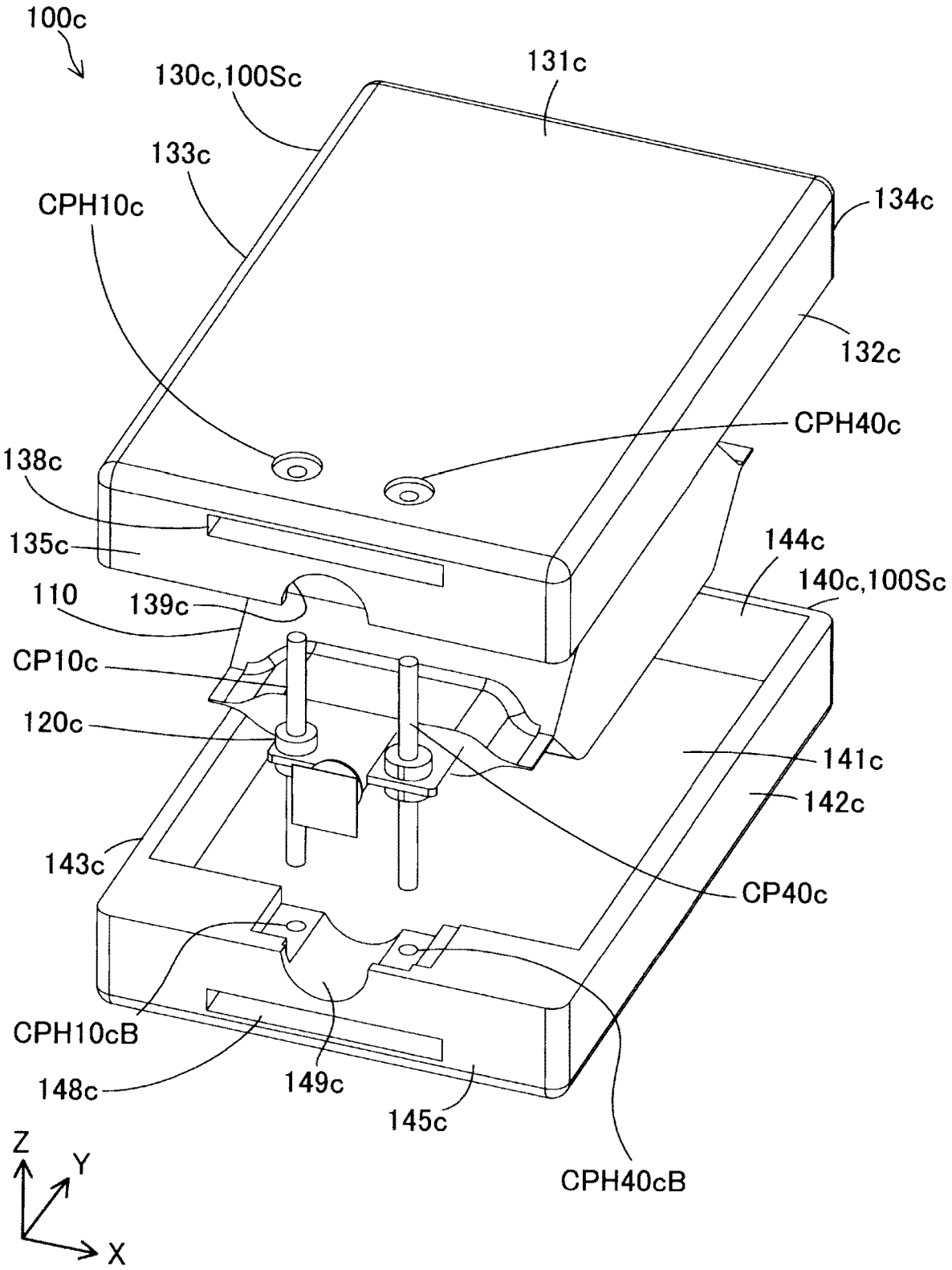
FIG. 11 is an exploded perspective view of the liquid container.

FIG. 10 is a perspective view of a liquid container 100*c* in a third embodiment of the present disclosure; FIG. 11 is an exploded perspective view of the liquid container 100*c*. Most of the configuration in the liquid container 100*c* is substantially the same as that in the liquid container 100*b* in the foregoing second embodiment. Thus, only different configuration features of the liquid container 100*c* will be described below. Thus, configuration features of the liquid container 100*c* which will not be described below are substantially the same as those of the liquid container 100*b*. In individual drawings, components of the liquid container 100*c* which correspond to those in the liquid container 100*b* are denoted by reference characters ending in "c" instead of "b".

A first case 130*c* of the liquid container 100*c* includes a first wall 131*c*, a second wall 132*c*, a third wall 133*c*, a fourth wall 134*c*, and a fifth wall 135*c*. The fifth wall 135*c*, which may be a substantially rectangular, flat shape and parallel to the ZX plane, protrudes vertically from one short side of the first wall 131*c* and faces the fourth wall 134*c*. One short side of the fifth wall 135*c* is coupled to one short side of the second wall 132*c*, whereas the other short side of the fifth wall 135*c* is coupled to one short side of the third wall 133*c*. The fifth wall 135*c* is greater in thickness than any of the second wall 132*c*, the third wall 133*c*, and the fourth wall 134*c*.

The fifth wall 135*c* of the first case 130*c* includes two through-holes; through-holes CPH10*c* and CPH40*c*, which are formed across the fifth wall 135*c* in parallel with the short sides of the fifth wall 135*c*, or in the +Z direction in FIG. 11. Both of the through-holes CPH10*c* and CPH40*c* are arrayed in the +X direction in FIG. 11. Each of the through-holes CPH10*c* and CPH40*c* is open in a portion of the outer surface of an outer shell 100Sc which forms the first wall 131*c*. Formed around the through-holes CPH10*c* and CPH40*c* are countersinks, which receive flanges of the swaging pins CP10*c* and CP40*c*, as illustrated in FIG. 11.

The fifth wall 135*c* further includes a through-hole 138*c* formed vertically across the fifth wall 135*c*. The through-hole 138*c* is positioned near one of the long sides of the fifth wall 135*c* which is coupled to the first wall 131*c*. The through-hole 138*c* has a substantially rectangular shape with its long sides parallel to those of the fifth wall 135*c* and is elongated in the +X direction in FIGS. 10 and 11. The through-hole 138*c* is positioned within an area containing both the through-holes CPH10*c* and CPH40*c*, as viewed from the +X direction. In other words, the through-hole 138*c* is formed inside the fifth wall 135*c* so as to intersect both of the through-holes CPH10*c* and CPH40*c*.

The fifth wall 135*c* further includes a notch 139*c* at substantially the center of one of the long sides of the fifth wall 135*c* which is not coupled to the first wall 131*c*. The notch 139*c*, which may have a semicircular shape, is formed vertically across the fifth wall 135*c*.

The second case 140*c* includes a first wall 141*c*, a second wall 142*c*, a third wall 143*c*, a fourth wall 144*c*, and a fifth wall 145*c*, as illustrated in FIG. 11. The fifth wall 145*c* includes through-holes CPH10*c*B, CPH40*c*B, and 148*c* and a notch 149*c*. When the liquid container 100*c* is completely assembled, the second case 140*c* is substantially symmetrical to the first case 130*c* with respect to the plane parallel to the XY plane.

When the liquid container 100*c* is completely assembled, the through-hole CPH10*c*B of the second case 140*c* is substantially symmetrical to the through-hole CPH10*c* of the first case 130*c* with respect to the plane parallel to the XY plane, whereas the through-hole CPH40*c*B of the second case 140*c* is substantially symmetrical to the through-hole CPH40*c* of the first case 130*c* with respect to the plane parallel to the XY plane. When the liquid container 100*c* is completely assembled, the through-hole 148*c* of the second case 140*c* is substantially symmetrical to the through-hole 138*c* of the first case 130*c* with respect to the plane parallel to the XY plane.

When the first case 130*c* and the second case 140*c* that have been joined together are viewed from the −Z direction, the through-hole CPH10*c* of the first case 130*c* is overlaid with the through-hole CPH10*c*B of the second case 140*c*, and the through-hole CPH40*c* of the first case 130*c* is overlaid with the through-hole CPH40*c*B of the second case 140*c*, as illustrated in FIG. 11.

When the liquid container 100*c* is completely assembled, the notch 149*c* of the second case 140*c* is substantially symmetrical to the notch 139*c* of the first case 130*c* with respect to the plane parallel to the XY plane.

When the liquid container 100*c* is completely assembled, the notch 139*c* of the fifth wall 135*c* of the first case 130*c* and the notch 149*c* of the fifth wall 145*c* of the second case 140*c* form a single through-hole across an outer shell 100Sc. Both the first case 130*c* and the second case 140*c* fix a fixing member 120*c* while positioning a portion of the fixing member 120*c* inside the above through-hole, thereby fixing a bag 110 to the outer shell 100Sc. Via this through-hole, a liquid passage of the fixing member 120*c* leads to the outside, as illustrated in FIG. 10. The end of the liquid passage of the fixing member 120*c* is sealed by a rectangular film, as illustrated in FIG. 10.

The fixing member 120*c* has two swaging pins: swaging pins CP10*c* and CP40*c*, as illustrated in FIG. 11, each of which is a bar-shaped member extending vertically to the liquid passage of the fixing member 120*c* which is coupled to the bag 110. The swaging pins CP10*c* and CP40*c* extend in the ±Z directions in FIG. 11 and are arranged on the respective sides of the liquid passage.

Figure 12:
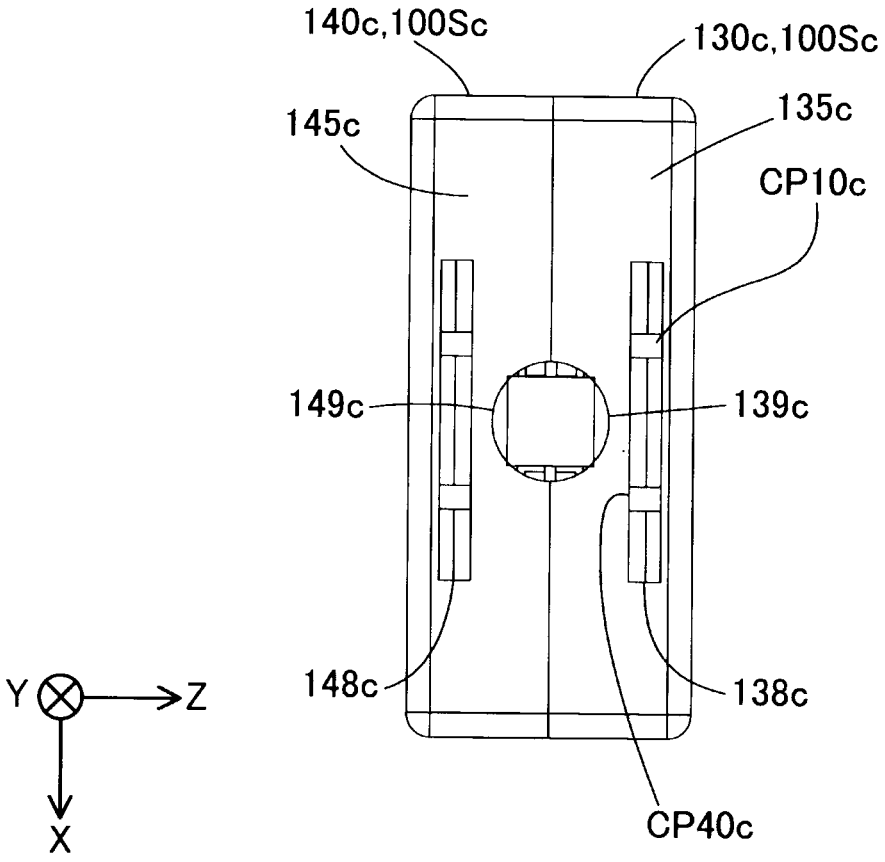
FIG. 12 is a front view of the liquid container.
Figure 13:
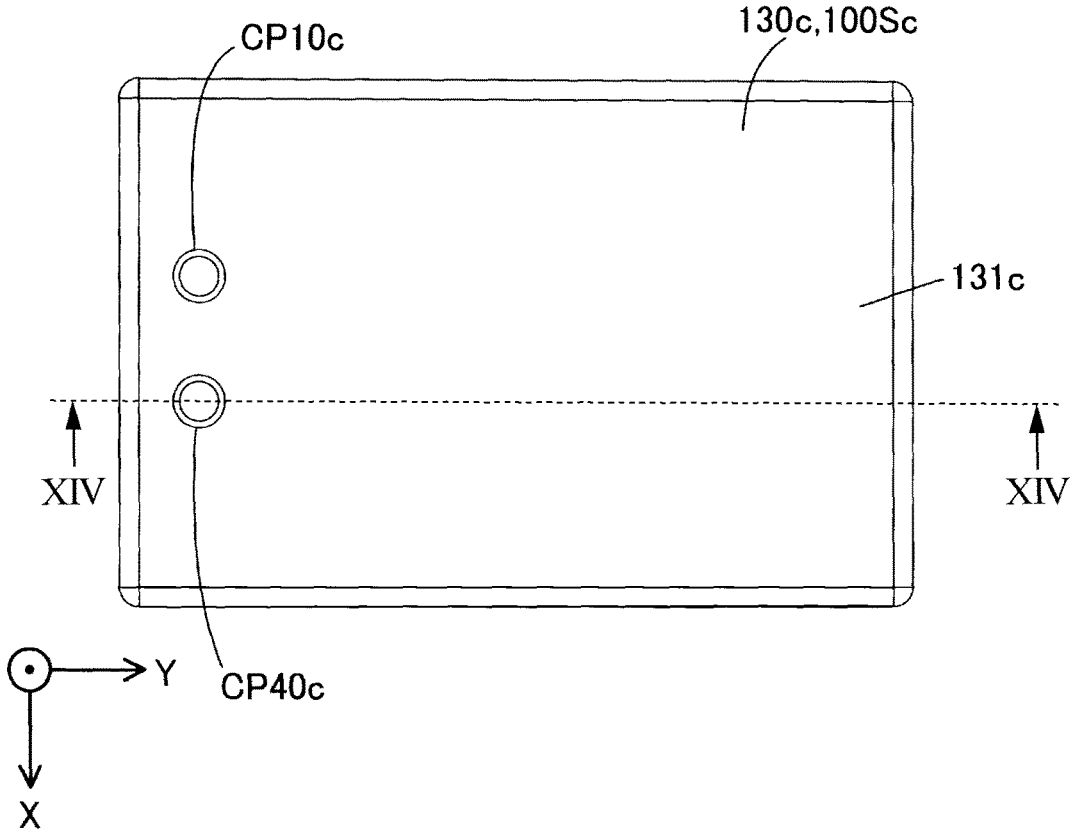
FIG. 13 is a top view of the liquid container.
Figure 14:
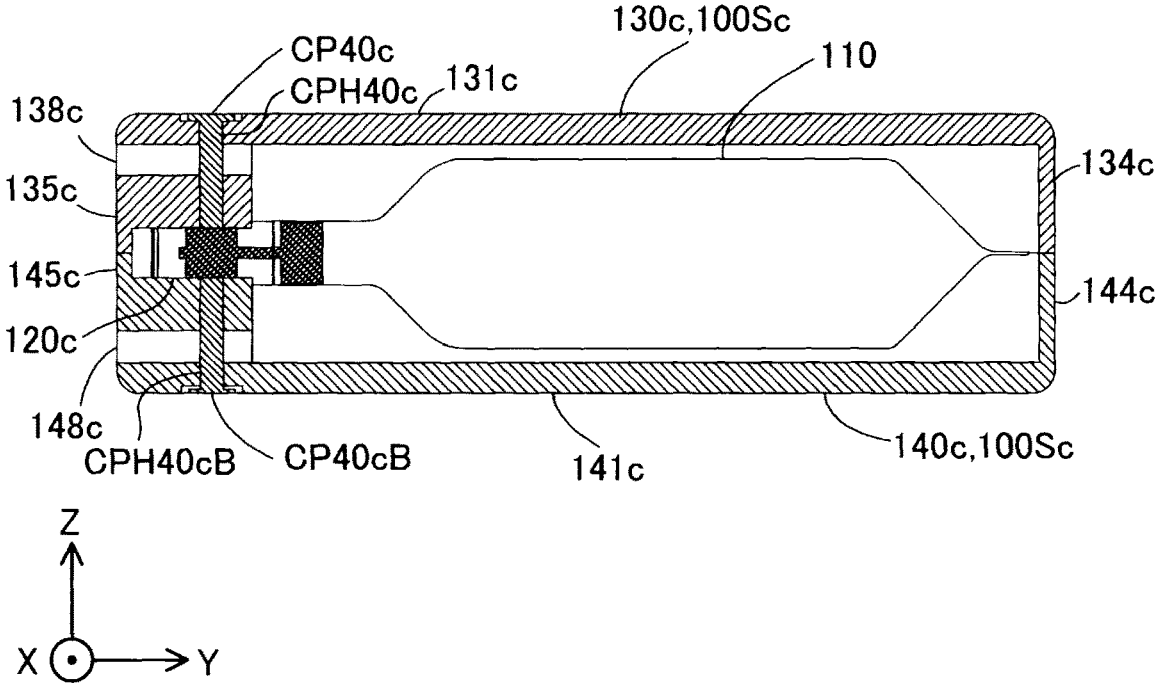
FIG. 14 is a cross-sectional view of the liquid container taken along the line XIV-XIV in FIG. 13.

FIG. 12 is a front view of the liquid container 100*c*; FIG. 13 is a top view of the liquid container 100*c*; and FIG. 14 is a cross-sectional view of the liquid container 100*c* taken along the line XIV-XIV in FIG. 13.

When bonding the first case 130*c* to the second case 140*c*, the user passes the swaging pin CP10*c* of the fixing member 120*c* into both the through-hole CPH10*c* of the first case 130*c* and the through-hole CPH10*c*B of the second case 140*c* while aligning the through-holes CPH10*c* and the CPH10*c*B with each other. Likewise, the user passes the swaging pin CP40*c* of the fixing member 120*c* into both the through-hole CPH40*c* of the first case 130*c* and the through-hole CPH40*c*B of the second case 140*c* while aligning the through-holes CPH40*c* and CPH40*c*B with each other, as illustrated in FIGS. 11 and 14.

Figure 15:
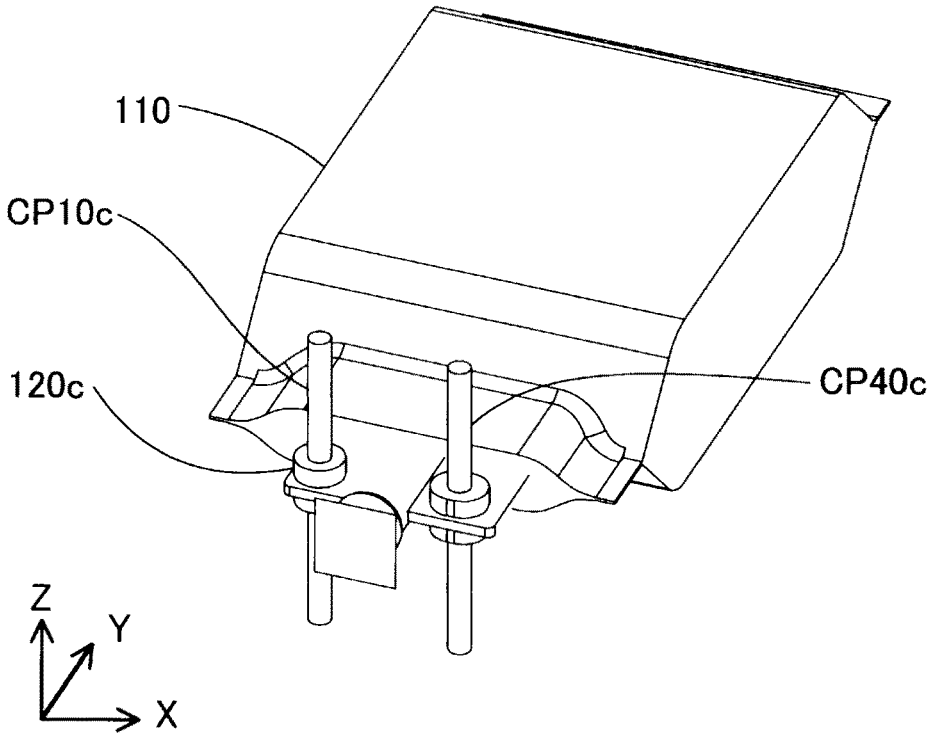
FIG. 15 is a perspective view of the fixing member and the bag to be mounted in the liquid container.
Figure 16:
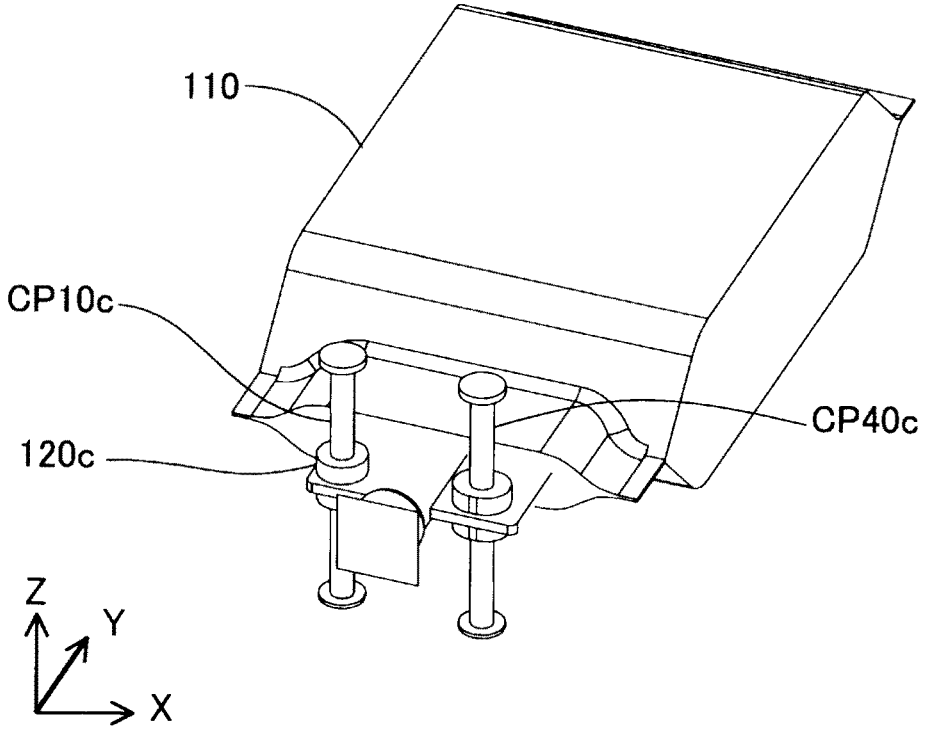
FIG. 16 is a perspective view of the bag and the fixing member mounted in the liquid container with the ends of the swaging pins deformed.

FIG. 15 is a perspective view of the fixing member 120*c* and the bag 110 to be mounted in the liquid container 100*c*; FIG. 16 is a perspective view of the bag 110 and the fixing member 120*c* mounted in the liquid container 100*c* with the ends of the swaging pins CP10*c* and CP40*c* deformed.

After having passed both the swaging pins CP10*c* and CP40*c*, the user deforms the end of the swaging pin CP10*c* which protrudes from the first case 130*c*. More specifically, he/she widens the end of the swaging pin CP10*c* to the extent that the end of the swaging pin CP10*c* cannot be inserted into the through-hole CPH10*c*B, thereby forming a flange of the swaging pin CP10*c*, as illustrated in FIGS. 14 and 16.

Likewise, the user deforms the end of the swaging pin CP10*c* which protrudes from the second case 140*c* via the through-hole CPH40*c*. Furthermore, the user deforms both ends of the swaging pin CP40*c* which protrude from the first case 130*c* via the through-hole CPH40*c* and from the second case 140*c* via the through-hole CPH40*c*B. In this way, the first case 130*c* is fixed to the second case 140*c* by the swaging pins CP10*c* and CP40*c*, as illustrated in FIGS. 10, 13, and 14.

When the liquid container 100*c* is completely assembled, the first case 130*c* is fixed to the second case 140*c* by the swaging pins CP10*c* and CP40*c* of the fixing member 120*c*, as illustrated in FIGS. 10 and 14.

When the liquid container 100*c* is completely assembled, the swaging pins CP10*c* and CP40*c* are viewable from the outside via the through-hole 138*c* of the first case 130*c* and the through-hole 148*c* of the second case 140*c*, as illustrated in FIG. 12.

When the liquid in the bag 110 is fully consumed, a user needs to perform the following steps, including a step of replacing the empty bag 110 and the fixing member 120*c* with new ones, in order to assemble the liquid container 100*c*.

First, the user inserts a cutting tool into the outer shell 100Sc via the through-hole 138*c* of the first case 130*c* or via the through-hole 148*c* of the second case 140*c* and then cuts off the swaging pins CP10*c* and CP40*c*, as illustrated in FIG. 12. Then, he/she removes the swaging pins CP10*c* and CP40*c* from the outer shell 100Sc and separates the first case 130*c* from the second case 140*c*.

The above configuration in the third embodiment enables the user to easily break and remove the swaging pins CP10*c* and CP40*c* from the outside of the outer shell 100Sc via the through-hole 138*c* or 148*c* in the outer shell 100Sc.

After having separated the first case 130*c* from the second case 140*c*, the user replaces the fixing member 120*c* and the bag 110 with new ones and attaches the new fixing member 120*c* and bag 110 to the first case 130*c* or the second case 140*c*. Then, he/she joins the first case 130*c* to the second case 140*c* with the fixing member 120*c* and the bag 110 therebetween.

The user passes the swaging pin CP10*c* of the fixing member 120*c* through both the through-hole CPH10*c* of the first case 130*c* and the through-hole CPH10*c*B of the second case 140*c* while aligning the through-holes CPH10*c* and CPH10*c*B with each other. Likewise, the user passes the swaging pin CP40*c* of the fixing member 120*c* through both the through-hole CPH40*c* of the first case 130*c* and the through-hole CPH40*c*B of the second case 140*c* while aligning the through-holes CPH40*c* and CPH40*c*B with each other. The remaining steps are substantially the same as those of assembling the liquid container 100*c* for the first time.

The configuration in the third embodiment enables the user to easily reassemble the liquid container 100*c* simply by replacing the bag 110 and the fixing member 120*c* equipped with the swaging pins CP10*c* and CP40*c* with new ones.

Herein, the combination of the first case 130*c* and the second case 140*c* in the third embodiment may correspond to a pair of members.

D. Modifications

D1. First Modification (1) In the foregoing first embodiment, twelve projections (CP10*a* to CP60*a* and CP10*a*B to CP60*a*B) are formed in the lid 150*a* as swaging pins, as illustrated in FIGS. 2 to 4. However, those swaging pins may be formed in the first case 130*a* or the second case 140*a*. Alternatively, the swaging pins may be formed in both the lid 150 and the first case 130*a* or both the lid 150 and the second case 140*a* to be fixed to each other.

(2) In the foregoing first embodiment, the lid 150*a* has twelve swaging pins (projections CP10*a* to CP60*a* and CP10*a*B to CP60*a*B), as illustrated in FIGS. 2 to 4. In the foregoing second embodiment, the liquid container 100*b* has two swaging pins (CP10*b* and CP40*b*), as illustrated in FIGS. 6 and 9. In the foregoing third embodiment, the fixing member 120*c* has two swaging pins (CP10*c* and CP40*c*), as illustrated in FIGS. 11 and 14 to 16. However, a liquid container may have one, three, four, five, seven, eight, or more swaging pins.

(3) In the foregoing embodiments, each of the outer shells 100Sa to 100Sc entirely covers the bag 110, as illustrated in FIGS. 1 and 5 to 10). However, an outer shell may partly expose a bag to the outside, in other words, may have only to surround the bag.

D2. Second Modification

In the foregoing first embodiment, the lid 150*a* has twelve projections (CP10*a* to CP60*a* and CP10*a*B to CP60*a*B) as swaging pins, as illustrated in FIGS. 2 to 4. The lid 150*a* is fixed to the first case 130*a* by two of the projections CP10*a* to CP60*a*, as illustrated in FIGS. 1 and 3, and also fixed to the second case 140*a* by two of remaining ones of the projections CP10*a*B to CP60*a*B. However, a pair of members may be fixed to each other by all swaging pins provided in one or both of the pair of members.

D3. Third Modification

In the foregoing second embodiment, the swaging pins CP10*b* and CP40*b*, by which the first case 130*b* is fixed to the second case 140*b*, are independent members, as illustrated in FIG. 6. However, the swaging pins may be integrated with one of a pair of members to be fixed to each other by these swaging pins, as illustrated in FIG. 2.

D4. Furth Modifications

In the foregoing third embodiment, the fixing member 120*c* has two swaging pins (CP10*c* and CP40*c*), as illustrated in FIG. 11. However, the fixing member 120*c* has one, three, or more swaging pins. Alternatively, another member that is coupled to a bag and independent of a fixing member may have swaging pins.

D5. Fifth Modification

In the foregoing second embodiment, the swaging pin CP40*b* is viewable from the outside via both the through-hole 136*b* of the first case 130*b* and the through-hole 156*b* of the lid 150*b* and via both the through-hole 148*b* of the second case 140*b* and the through-hole 158*b* of the lid 150*b*, as illustrated in FIGS. 6 and 8. In the foregoing third embodiment, the swaging pin CP40*b* is viewable from the outside via the through-hole 138*c* of the first case 130*c* and the through-hole 148*c* of the second case 140*c*, as illustrated in FIGS. 11 and 12.

However, an outer shell may have a through-hole via which swaging pins are not viewable from the outside but a user can access and break the swaging pins by using a special tool. Alternatively, the outer shell may have no through-holes via which a user can access swaging pins, as in the foregoing first embodiment.

E. Other Modifications

The present disclosure is not limited to the foregoing embodiments and may be implemented in various aspects within its spirit. For example, the present disclosure may be implemented in the aspect that will be described below. The technical features in the foregoing embodiments which are equivalent to those in the aspect can be replaced with others or combined together as appropriate in order to address some or all of the disadvantages of the present disclosure or accomplish some or all the effects of the present disclosure. The technical features in the foregoing embodiments may be deleted as appropriate if they are not described as being essential herein.

(1) According to an aspect of the present disclosure, a liquid container includes: a bag that contains a liquid; and a pair of members configured to be reused when the liquid container is reassembled by replacing the bag used. The pair of members are fixed to each other by one or more swaging pins.

The above configuration enables a user to easily break swaging pins and detach a plurality of members from one another even when a liquid container has undergone temperature changes.

(2) In the liquid container of the aspect, at least one of the pair of members may be provided with the swaging pins configured to fix the pair of members to each other. The pair of members may be fixed to each other by one or more of swaging pins.

The above configuration enables a user to, when reusing a pair of members, fix these members to each other by one or more unused swaging pins. Therefore, the user can reuse the pair of members to reassemble a liquid container while maintaining the strength at which the pair of members are fixed to each other, regardless of how many times the pair of members have been reused. Moreover, since the number of times that the pair of members can be reused is related to the number of swaging pins to be used, the user can easily know how many times the pair of members can be reused, based on the configuration of the liquid container.

(3) In the liquid container of the aspect, the pair of members may be members independent of the swaging pins.

The above configuration enables a user to fix the pair of members to each other by using new swaging pins when a pair of members are reused. Therefore, the user can reuse the pair of members in order to reassemble a liquid container while maintaining the strength at which the pair of members are fixed to each other, regardless of how many times the pair of members have been reused. This configuration enables the user to reuse the pair of members to each other, regardless of how many times swaging pins have been broken when the liquid container is reassembled. Since the user replaces swaging pins but reuses the pair of members when assembling the liquid container, the swaging pins are permitted to be damaged or deformed when the pair of members are detached from each other, but it is preferable for the pair of members not to be damaged or deformed. Consequently, the swaging pins and the pair of members have different roles and functions, thereby making it possible to easily design parts of the pair of members which receive the swaging pins.

(4) In the liquid container of the aspect, the pair of members may be members that form at least a portion of an outer shell surrounding the bag. This liquid container may further include a fixing member that fixes the bag to the outer shell. The fixing member may be provided with the swaging pins.

The above configuration enables a user to easily reassemble a liquid container simply by replacing a bag and a fixing member equipped with swaging pins with new ones.

(5) The liquid container of the aspect may further include an outer shell surrounding the bag. The outer shell may have a through-hole via which the swaging pins by which the pair of members are fixed to each other are viewable from an outside.

The above configuration enables a user to easily break and remove swaging pins from the outside of an outer shell via a through-hole.

The present disclosure can be implemented in various forms of liquid containers. Examples of such forms include: a method of manufacturing a liquid container; a computer program for realizing a method of controlling a liquid container; and a nonvolatile recording medium that stores the computer program.

What is claimed is:

1. A liquid container comprising:
a bag that contains a liquid; and
a pair of members configured to be reused when the liquid container is reassembled by replacing the bag used,
the pair of members being fixed to each other by one or more swaging pins, wherein
the pair of members are members that form at least a portion of an outer shell surrounding the bag,
the liquid container further comprises a fixing member that fixes the bag to the outer shell, and
the fixing member is provided with the swaging pins.

2. The liquid container according to claim 1, wherein
at least one of the pair of members is provided with the swaging pins configured to fix the pair of members to each other, and
the pair of members are fixed to each other by one or more of the swaging pins.

3. The liquid container according to claim 1, wherein
the pair of members are members independent of the swaging pins.

4. The liquid container according to claim 1, wherein
the outer shell has a through-hole via which the swaging pins by which the pair of members are fixed to each other are viewable from an outside.

5. A liquid container comprising:
a bag that contains a liquid;

a pair of members configured to be reused when the liquid container is reassembled by replacing the bag used, the pair of members being fixed to each other by one or more swaging pins; and an outer shell surrounding the bag, wherein the outer shell has a through-hole via which the swaging pins by which the pair of members are fixed to each other are viewable from an outside.

6. The liquid container according to claim 5, wherein at least one of the pair of members is provided with the swaging pins configured to fix the pair of members to each other, and the pair of members are fixed to each other by one or more of the swaging pins.

7. The liquid container according to claim 5, wherein the pair of members are members independent of the swaging pins.

8. The liquid container according to claim 5, wherein the pair of members are members that form at least a portion of the outer shell surrounding the bag, the liquid container further comprises a fixing member that fixes the bag to the outer shell, and the fixing member is provided with the swaging pins.

* * * * *